United States Patent [19]

Wright et al.

[11] 4,078,488

[45] Mar. 14, 1978

[54] METHOD OF PREPARING A PRINTING SCREEN BY MOLDING

[75] Inventors: Martin Edward John Wright, Wycombe; Clinton Brian Barker, Kidmore End, both of England

[73] Assignee: Engineering Components Limited, England

[21] Appl. No.: 708,096

[22] Filed: Jul. 23, 1976

[30] Foreign Application Priority Data

Jul. 26, 1975 United Kingdom ..... 31367/75

[51] Int. Cl.[2] ..... B41C 1/14; B41F 15/36

[52] U.S. Cl. ..... 101/128.4; 101/128.2; 264/299

[58] Field of Search ..... 101/127, 129, 128.2, 101/128.4, 114, 123, 128.3; 427/143, 256, 259, 272, 282; 118/213, 504; 264/257, 259, 297, 299, 334; 96/36.4

[56] References Cited

U.S. PATENT DOCUMENTS

| | | | |
|---|---|---|---|
| 1,594,743 | 8/1926 | Matthews et al. | 101/128.2 |
| 1,698,166 | 1/1929 | Menzer | 1 01/128.2 X |
| 1,715,350 | 6/1929 | Booth | 101/129 |
| 2,949,848 | 8/1960 | Mott | 101/128.3 |
| 3,198,109 | 8/1965 | Dwyer et al. | 101/128.3 X |
| 3,198,111 | 8/1965 | Ellis et al. | 101/170 |
| 3,225,691 | 12/1965 | Kehe et al. | 101/128.4 X |
| 3,507,653 | 4/1970 | Preddy et al. | 101/128.3 X |
| 3,632,375 | 1/1972 | Gipe | 101/450 X |
| 3,650,796 | 3/1972 | Jackson et al. | 427/256 X |
| 3,696,742 | 10/1972 | Parts et al. | 101/128.4 |
| 3,751,204 | 8/1973 | Baker | 101/123 X |
| 3,909,256 | 9/1975 | Wells | 101/128.4 X |
| 3,925,530 | 12/1975 | Rees | 264/297 |
| 3,945,830 | 3/1976 | Yazawa et al. | 101/456 X |
| 3,949,142 | 4/1976 | Doggett | 101/450 X |

FOREIGN PATENT DOCUMENTS

| | | |
|---|---|---|
| 964,099 | 1950 | France. |
| 2,256,263 | 1973 | Germany. |
| 905,022 | 1954 | Germany. |
| 704,148 | 1954 | United Kingdom. |
| 954,459 | 1964 | United Kingdom. |
| 859,048 | 1961 | United Kingdom. |

*Primary Examiner*—Ronald E. Suter
*Attorney, Agent, or Firm*—Cushman, Darby & Cushman

[57] ABSTRACT

A screen for use in a silk screen printing process is made by a process comprising the steps of forming a positive image of a desired print, applying it to a screen so as to obstruct apertures therein corresponding to said positive image, filling all unobstructed apertures in the screen with a flexible polymeric material and then removing the positive image.

3 Claims, 2 Drawing Figures

METHOD OF PREPARING A PRINTING SCREEN BY MOLDING

BACKGROUND OF THE INVENTION

The present invention relates to printing and in particular to silk screen and other printing processes wherein an apertured screen has selected apertures occluded so that in use, a fluid composition is inhibited from entering them. The occluded apertures are so disposed as to constitute in negative form an image of the design to be printed and the screen is usually a fabric having a relatively open weave to provide the apertures.

In the past such screens have been made by various methods including purely manual techniques whereby the screen has the negative design worked into it by hand-filling the selected apertures with gelatine or shellac. Not only is this a very slow operation requiring great skill, but the product tends to be of limited durability when used on an industrial scale. More commonly, however, photographic methods are used, wherein a photosensitive material is applied to the screen as a sheet or as emulsion. An positive opaque image of the desired print is then superimposed onto the sheet and the whole exposed to light which "fixes" the exposed areas of the photosensitive material outside the opaque image, leaving the part covered by the latter amenable to removal by a solvent treatment.

While these photographic techniques do give improved durability, continued flexing of the screen in use causes progressive damage to the aperture-occluding material which tends to part company with the screen, leaving pinholes and/or jagged edges to the outline of the desired print. There is also a risk that long-term exposure to printing fluids will slowly dissolve out the occluding material. Periodic drying of the screen slows down this leaching process, but it involves stopping production which is often commercially undesirable. Protective coatings can be used, but also have a limited utility, being liable to mechanical damage by the printing process itself.

DETAILED DESCRIPTION OF THE INVENTION

Figure 1:
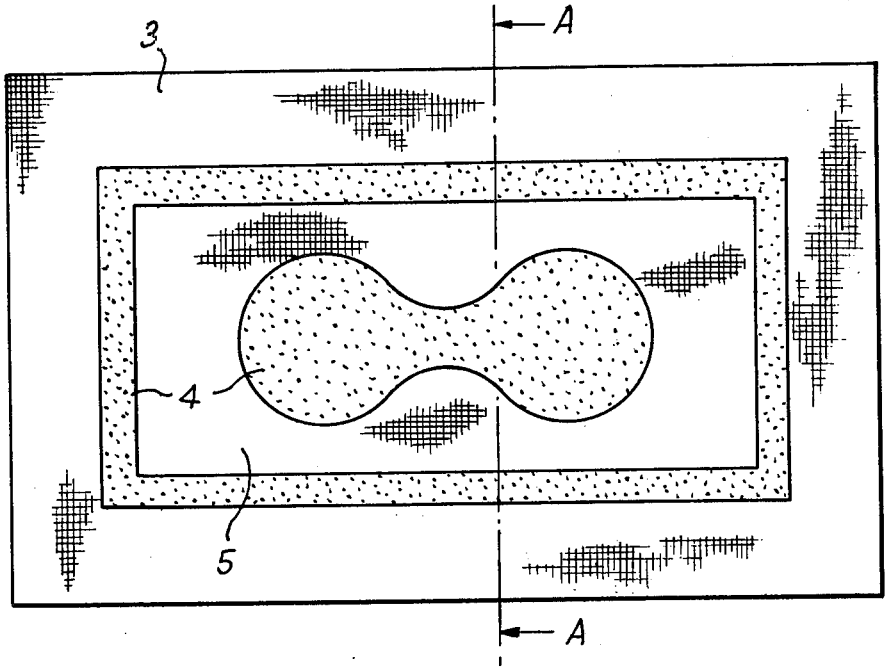

According to the present invention, a method of manufacturing a screen for use in a screen printing process comprises the steps of forming a positive image of a desired print, applying it to a screen so as to obstruct apertures therein corresponding to said positive image, filling all unobstructed apertures in the screen with a flexible polymeric material, and then removing the positive image.

Preferably, the polymeric material is applied as a paste or liquid. Where appropriate, it may be cured in situ after application, but before removal of the positive image. Preferably, the polymeric material exhibits a low shinkage on curing. It may with advantage be selected so as to be essentially inert to the printing fluid.

In order to obtain a satisfactory, complete filling of the apertures, the screen is preferably located both parallel and close to a flat plate during the filling operation, if necessary with a release layer between it and the screen to prevent the polymeric material becoming firmly adhered to the plate.

Nylon or steel wire fabric is suitable for the screen and silicone rubber compositions, especially those curable at room temperature can conveniently be used as the polymeric material.

The positive image of a desired print may be formed by any convenient method.

While the process just described provides a durable screen well-suited to conventional printing processes, it can also by a slight modification be used to produce a screen capable of printing an image of greater thickness than has previously been possible in a single printing operation. Optionally, this increased thickness need not be uniform over the whole area of the printed image. This latter feature is particularly useful where the screen is used to print a sealing gasket having variations in thickness where such are frequently required at a particular part of the gasket. Conventional screen-type printing would require the use of multiple impressions with different screens in order to build up the desired thickness variations and even then for all practical purposes, the variations would be stepwise rather than a smooth transition from one thickness to another.

According to a particularly preferred embodiment of the present invention, a process for manufacturing a screen for use in a screen printing process includes the steps of forming a positive image of a desired print by any convenient method and applying it to a screen so as to obstruct apertures therein correponding to said positive image, placing the screen on a female mould surface having depressions therein corresponding in depth to the thickness of the layer of material it is desired to print, filling all unobstructed apertures in the screen with a flexible polymeric material while at the same time forcing through said apertures sufficient polymeric material to fill the depressions, followed by removing the positive image and the mould.

Preferably the polymeric material is applied as a paste or liquid. Where appropriate, it may be cured in situ after application, but before removing the image and the mould.

The resultant screen carries not only a negative image of the desired print, but also has on one side of it relatively raised areas bordering the image. These raised areas in conjunction with the negative image impart an essentially three-dimensional characteristic to one face of the screen. With this face as the substrate-contacting face in a silk-screen printing process, this three-dimensional characteristic is reproduced in the print deposit on the substrate.

Where sealing material is to be printed onto a flat gasket, the relative thickness of the deposit can be adjusted to meet the operational requirements of the gasket at any particular point by preparing the female mould in accordance with the usual type of load diagram produced to show the in-service distortions of the parts which the gasket is to join. A typical load diagram would be made by inserting superposed sheets of carbon paper and white paper between the gasket and the parts which it joins. On tightening the mounting hardware, carbon will be transferred to the white paper in proportion to the loading at any point and an examination of the white paper afterwards will show the distribution of the sealing pressure within the assembly. If a greater sealing pressure is required at any pint the female mould can be made somewhat deeper so as to give a thicker deposit at that point. A process according to the invention may further include th step of preparing the female mould surface.

The invention also includes screens made by a process according to the invention and articles, particularly gaskets, printed with the aid of such screens.

Figure 2:
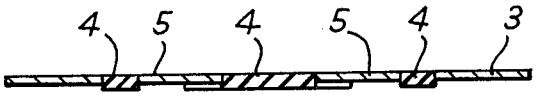

In order that the invention be better understood a preferred embodiment of it will now be described by way of example with reference to the accompanying drawing in which;

FIG. 1 is a plan view of part of a screen prepared in accordance with the invention and FIG. 2 is a section along line AA of FIG. 1.

Referring to the figures a woven nylon mesh screen 3 has selected apertueres occluded by means of a silicone rubber material 4 leaving an open area 5 corresponding to an image to be printed. In FIG. 2 the three-dimensional nature of one face of the screen is apparent.

The screen was made by first preparing on it a positive image corresponding to the area to be occluded by the material 4. This was done by occluding all the apertures with a photosensitive emulsion which was allowed to dry. An opaque negative mask corresponding to the desired print was placed over the screen and the assembly exposed to light, thereby fixing the emulsion only in the desired print area. The unfixed emulsion was washed out.

Next a female mould surface was prepared having depressions corresponding in depth to the final thickness of print deposit desired, these depressions being, of course, outside the desired print area. In FIG. 2, the thickness shown is uniform, but as was explained earlier, this may not always be appropriate. The screen was clamped firmly onto the mould surface after coating the latter with a release agent and a room temperature vulcanising silicone rubber composition was worked into all the unoccluded apertures of the screen, sufficient material being forced through the screen to ensure that the depressions in the mould were filled. The material at the exposed face of the screen was kept as flat and as smooth as practicable to ensure that the finished screen would conform to the mould as closely as possible by having one flat face and one face with the desired three-dimensional characteristic.

When the rubber has cured the mould was removed and the fixed emulsion removed by a solvent treatment to leave the screen shown in the figures.

We claim:

1. A method of manufacturing a screen for use in a silk screen printing process, said method including the successive steps of: (a) forming a positive image of a desired print, (b) applying the thus formed image to a screen so as to obstruct apertures therein corresponding to said positive image (c) placing the screen on a mold surface having depressions therein corresponding in depth to the thickness of the layer of material to be printed, (d) filling all of the unobstructed apertures in the screen with a flexible room temperature vulcanizing silicone rubber composition which is inert to printing fluid while at the same time, (e) forcing through said apertures an amount of the silicone rubber composition at least sufficient to fill the depressions in the mold surface, (f) allowing the silicone rubber to cure in situ, and thereafter removing the positive image and the mold.

2. A method according to claim 1 wherein the flexible silicone rubber composition of step (e) is applied as a paste.

3. A method according to claim 1 wherein the flexible silicone rubber composition of step (e) is applied as a liquid.

* * * * *